United States Patent [19]

Lackey

[11] 4,139,052

[45] Feb. 13, 1979

[54] ROOF TOP AIR CONDITIONING UNIT

[75] Inventor: Robert S. Lackey, Pittsburgh, Pa.

[73] Assignee: Westinghouse Electric Corp., Pittsburgh, Pa.

[21] Appl. No.: 853,989

[22] Filed: Nov. 23, 1977

[51] Int. Cl.[2] ..... F28F 7/00; F25B 29/00; F25D 23/12

[52] U.S. Cl. ..... 165/59; 165/137; 62/326; 62/263; 62/259; 62/DIG. 16

[58] Field of Search ..... 165/137, 59; 62/326, 62/263, 259, DIG. 16

[56] References Cited

U.S. PATENT DOCUMENTS

| | | | |
|---|---|---|---|
| 2,401,560 | 6/1946 | Graham et al. | 62/129 |
| 2,690,654 | 10/1954 | Graham | 62/140 |
| 3,156,233 | 11/1964 | O'Connell | 126/110 |
| 3,678,993 | 7/1972 | Pierce | 62/326 |
| 3,977,467 | 8/1976 | Northrup, Jr. | 62/286 |
| 3,995,446 | 12/1976 | Eubank | 62/325 |

FOREIGN PATENT DOCUMENTS

| | | | |
|---|---|---|---|
| 2414443 | 10/1974 | Fed. Rep. of Germany | 165/137 |

*Primary Examiner*—Charles J. Myhre
*Assistant Examiner*—M. Moy
*Attorney, Agent, or Firm*—E. C. Arenz

[57] ABSTRACT

The air conditioning unit of the invention has a construction of the indoor air flow section which adapts it to receive and return indoor air either through its bottom area in a vertical air flow mode, or through its end wall in a horizontal air flow mode so that the unit may be either roof top mounted or slab mounted without the need of any added section or module furnished by the manufacturer. The indoor air flow section includes a draw-through refrigerant coil located in an upper quadrant of the section, a detachable panel separating two lower quadrants in the section for the vertical air flow mode and movable to separate a lower and upper quadrant for the horizontal air flow mode, and removable end wall panel means covering the end in the vertical air flow mode and being positioned to cover the bottom for the horizontal air flow mode. Additionally, the construction is such that the provision of electric heat, various air flow control options and adaptability of the unit to heat pump operation are all accommodated.

9 Claims, 6 Drawing Figures

ROOF TOP AIR CONDITIONING UNIT

CROSS REFERENCE TO RELATED APPLICATIONS

Kastovich et al. U.S. patent application Ser. No. 853,988 filed Nov. 23, 1977 (W.E. 47,465) and Young U.S. patent application Ser. No. 853,987 filed Nov. 23, 1977 are related applications.

BACKGROUND OF THE INVENTION

1. Field of the Invention

The invention pertains to the art of air conditioning units of the type adapted for either roof top or slab mounted installations.

2. Description of the Prior Art

There are numerous patents in the air conditioning art which disclose arrangements in which by rearranging inner partitions and/or end panels, air flow paths through the unit may be changed. Representative of such patents are the following: U.S. Pat. Nos. 2,401,560, 2,690,654, 3,156,233, 3,678,993, 3,977,467, 3,995,446 and German Pat. No. 2,414,443. However, in none of these is an arrangement shown which can attain all the objects of my invention.

However, as an aid in promoting a thorough understanding of the advantages of the arrangement of the invention, a discussion of some of the design desiderata relative to past commercial practices is considered warranted. The 1975 ASHRAE Equipment Handbook sets forth some of the matters of mechanical design of roof top units which should be taken into consideration. Among these it is noted that the cabinet height dimensions are important for roof top units since large units must be designed with consideration given to the limitations of truck bodies, freight cars, doorways, elevators and to the usual rigging practices. It also points out that the design should have sufficient structural strength to accommodate handling, warehouse stacking and shipment. Also, the cooling coil air velocities must be low enough to prevent entrainment of condensate. Service access must be provided for installation and repair, and versatility of application, such as multi-fan discharge direction and either-hand piping are valuable considerations. The handbook also points out that consideration should be given to permit various air flow options, such as air duct kits which can permit horizontal or vertical connections, and duct damper kits for control of outdoor air intake and exhaust.

Among considerations of this type to which attention was directed in accomplishing the arrangement of my invention were the following. The desired roof top unit should accommodate air flow into the indoor air flow section from either the bottom (a vertical air flow made arrangement) or from the end (a horizontal air flow mode) without requiring any added section or module as has been typical in the past. This was to be accomplished with reasonable compactness of the unit. It will be appreciated of course that if there are no limitations on how big a unit can be in any of the various directions, the matter of designing the unit to accomplish everything desired is relatively easy. However, as a rule the larger the unit the greater the cost. Further, one design restriction taken into account in my invention is that the height of the units of say 7½ and 10 tons refrigerating capacity be limited so that two of them can be stacked one upon the other and not exceed 90 inches to accommodate shipping by truck. At the same time, the supply and return openings, wherever they are located must be of at least a given size unit, as well as the interior air flow spaces must accommodate the required volume of air without excessive fan power required. Also with the particular air flow requirements, the refrigerant coil must have at least a given face area, and provision must be made for handling condensate for when the coil is functioning as a refrigerant evaporator.

It is also considered desirable that the particular unit be such that in its standard form it can be shipped to a distributor who would stock the unit, and be within the distributor's ability to change from a vertical air flow mode to a horizontal air flow mode at his location without having to stock separate add-on box sections to achieve the change. Since various air flow control options achievable by different damper arrangements is desirable, the unit should accommodate the installation of these damper elements at the distributor's location. Finally, it is desirable that the basic construction of the unit be such that it be adaptable for heat pump operation; in which case supplemental electric resistance heat will be required ordinarily. As is well known, electric heat must be located downstream from the refrigerant coil which acts as a condenser in the heating mode of the heat pump. This is because if the electric heat were upstream of the condenser, the condenser would be ineffective to add heat to the already heated air and also would generate problems of too high condensing temperatures and pressures and a low coefficient of performance. Now with the electric heat arrangement, there still exists the alternatives of having a blow-through or draw-through arrangement with respect to the location of the blower relative to the refrigerant coil. It is considered desirable in my view that the arrangement be that of draw-through the refrigerant coil and blow-through the electric heat so that a relatively high velocity air stream available at the discharge of the blower is directed over the heaters to thereby permit a high watt density heater arrangement.

As the description proceeds, it will become apparent that at least most of the basic design parameters treated herebefore are met with an arrangement according to my invention.

SUMMARY OF THE INVENTION

In accordance with the invention, the indoor air flow section, which may be viewed from the side as having four quadrantal spaces in a two dimensional sense, has the first space located in an upper corner bounded exteriorly by the end and top wall of the indoor section with a refrigerant coil in slanted disposition in it, and proceeding in a counterclockwise direction in sequence, has the blower means in the second quadrantal space, electric resistance heater means when used in the third quadrantal space, with the third and fourth quadrantal spaces being separated by a detachable panel and with end wall openings closed by panel means in the vertical air flow mode. To convert the unit to a horizontal air flow mode, the detachable panel is relocated from its vertical disposition separating the third and fourth quadrants to a horizontal disposition separating the fourth and first quadrants and the removable end panel means is relocated to open the end wall and placed in a horizontal disposition overlying the base wall openings at the bottom of the third and fourth quadrants. Other features of the invention, such as the ability to accommodate various air flow control options by means of damper arrangements, will be described in the following.

DRAWING DESCRIPTION

DESCRIPTION OF THE PREFERRED EMBODIMENT

Figure 1:
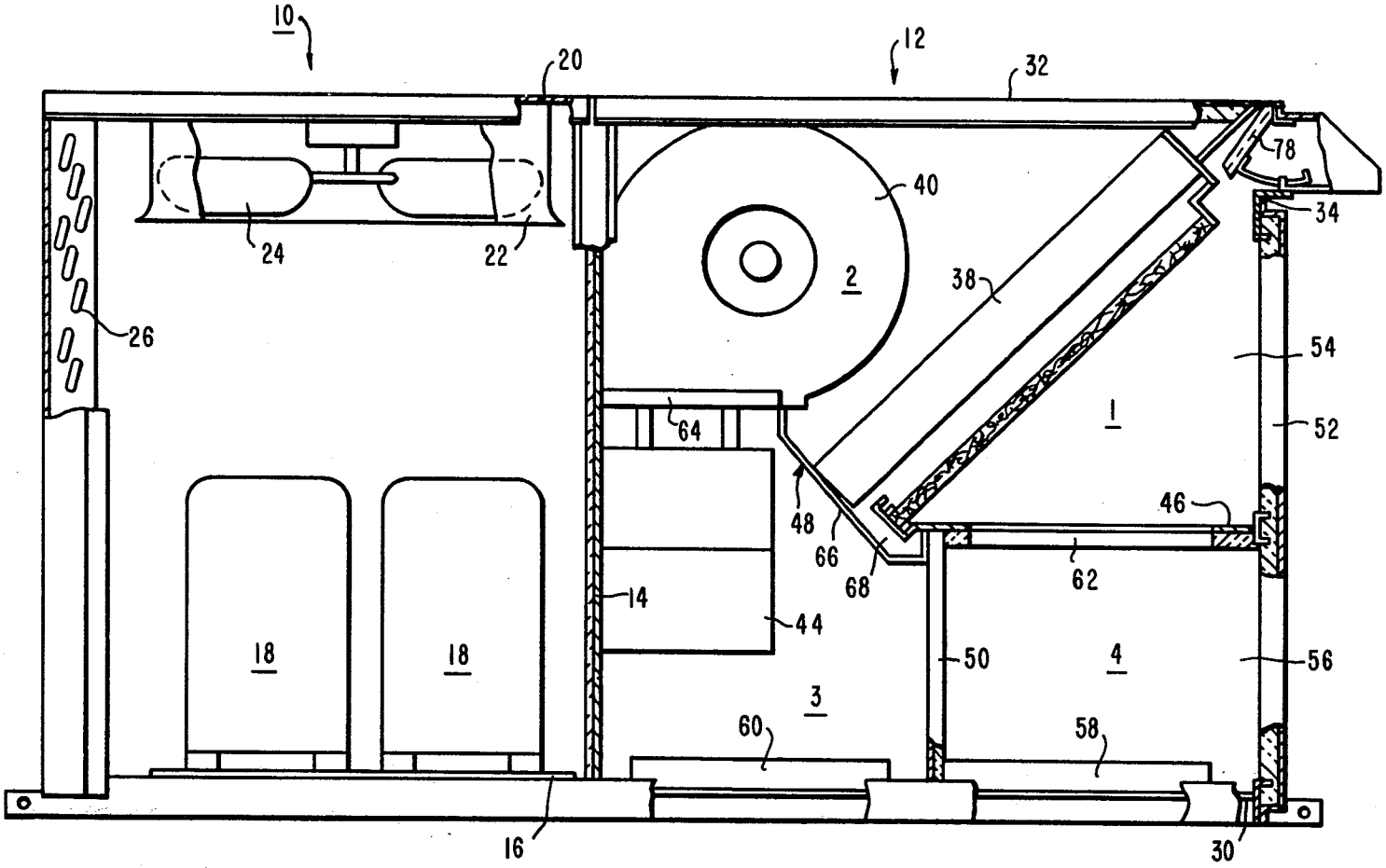
FIG. 1 is a side view of a roof top unit according to the invention with the panels facing the viewer being omitted, as well as the various electrical and refrigerant lines.

Referring to the drawing, the unit illustrated is adapted for either a roof top installation or a slab installation. It will be described primarily in connection with FIG. 1 which is the standard arrangement for a roof top installation in which a vertical air flow mode is used in that the return air and supply air are received and discharged in a vertical direction through the bottom wall of the unit.

Figure 2:
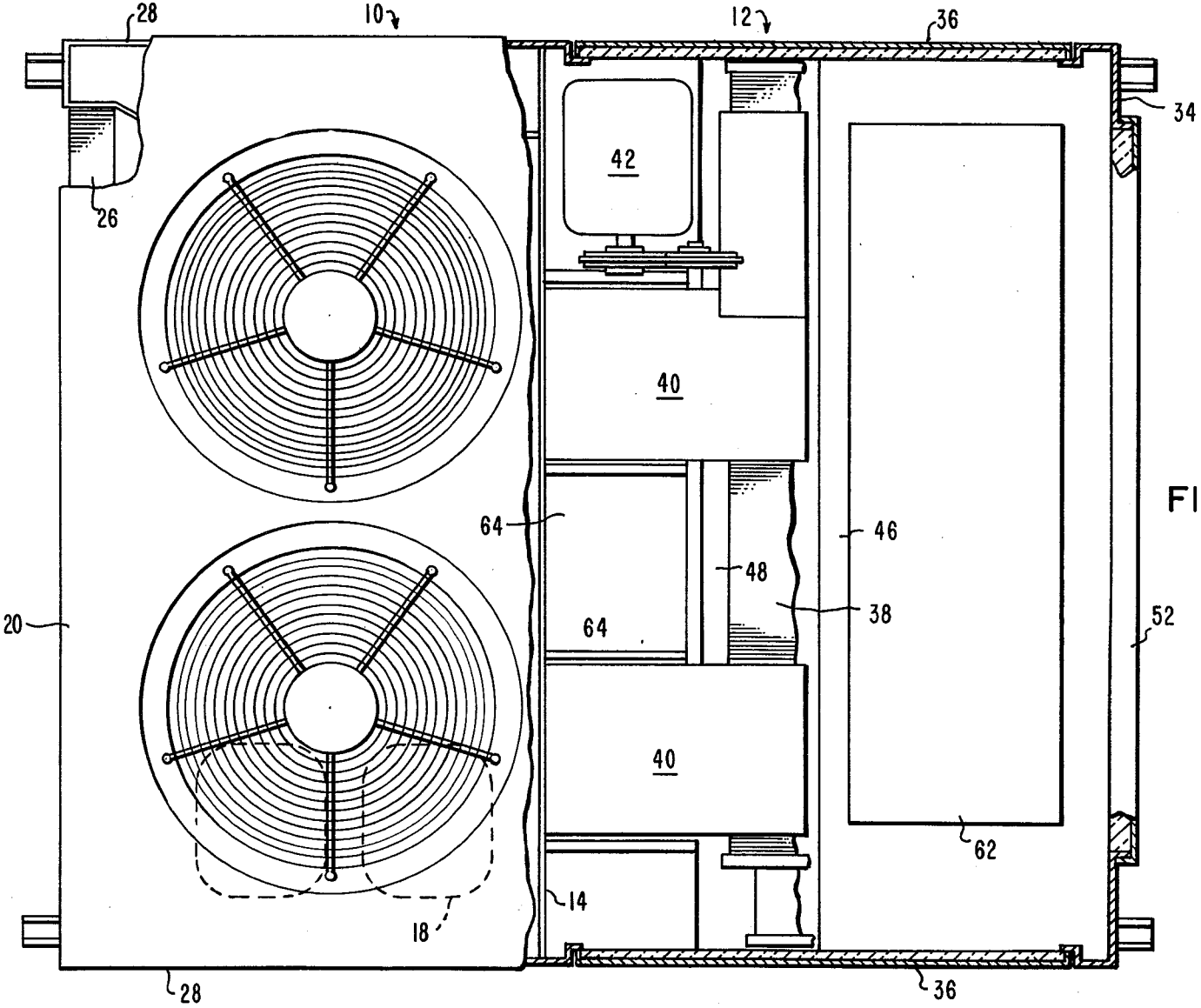
FIG. 2 is a partly broken top view of the unit to illustrate the locations of various parts.

Referring to FIGS. 1 and 2, the unit is basically divided into an outdoor air flow section 10 and an indoor air flow section 12, both within an outer casing or cabinet separated interiorly by an intermediate vertical partition 14. The outdoor section includes a base wall 16 upon which compressors 18 are mounted, a top wall 20 (FIG. 2) having a pair of openings therein to which the fan rings 22 are connected to channel the flow of condenser air created by condenser fans 24, an open end face within which is located the refrigerant coil 26 normally operating as a condenser in a cooling operation of the unit, and, opposite walls 28, both including removable panel elements.

The indoor air flow section, which is the subject of the invention, is housed in that part of the cabinet including base wall 30, top wall 32, end wall 34 and opposite side walls 36 (FIG. 2) in the form of removable panels. Included in the parts in the indoor air flow section 12 are a refrigerant coil 38 which functions as an evaporator in a cooling operation, a pair of centrifugal fans 40 driven by motor 42 (FIG. 2) and electric resistance heating sections or modules 44 (when used) spaced downstream from the discharge openings of the fans. Details of the construction of the modules 44 to provide the mounting and locational relation of the heating modules to the fan are the subject of Young U.S. patent application Ser. No. 853,987, filed Nov. 23, 1977 and reference should be had thereto for details on that subject.

The interior space of the indoor air flow section, viewed as a plane from the side as in FIG. 1, may be roughly considered to comprise four generally quadrantal spaces for purposes of description of the locational relationships of the elements to each other. All four quadrantal spaces are bounded on opposite sides by the opposite side walls 36. The other exterior bounds of course comprise the base and top walls, and the vertical partition 14 and end wall 34. For purposes of description in this application then, the first quadrantal space 1 is that bounded exteriorly by the top wall 32 and end wall 34, the second quadrantal space 2 is located in the other upper corner and is bounded by top wall 32 and vertical partition 14, the third quadrantal space 3 is located in a lower corner bounded by the partition 14 and the bottom wall 30, and the fourth quadrantal space 4 is located in a lower corner and bounded by the bottom wall 30 and end wall 34.

The indoor air flow section also includes interior wall means which serve to roughly separate some of the quadrants. These interior wall means include generally horizontally extending portions including one portion 46 generally separating the first and fourth quadrantal space, and another portion 48 which generally separates the second and third quadrantal space. A detachable panel 50, disposed vertically in FIG. 1, serves to separate the third and fourth quadrants in the vertical air flow mode of the unit.

The end wall 34 includes removable end panel means 52 which covers an upper air flow opening 54 which opens into the first quadrantal space when the panel is removed, and a second air flow opening 56 which opens into the fourth quadrantal space. With the end panel means in position as in FIG. 1, the bottom wall 30 of the unit has two uncovered air flow openings separated horizontally from each other and defined herein as the third air flow opening 58 open to the fourth quadrantal space and a fourth air flow opening 60 open to the third quadrantal space.

The portion 46 of the generally horizontally extending interior wall means which separates the first and fourth quadrants includes an air flow opening 62 which is herein defined as the fifth air flow opening and it generally overlies the third air flow opening 58 in the bottom wall.

The other portion 48 of the generally horizontally extending interior partition means includes one part 64 which is at an elevated level relative to the first portion 46 of the generally horizontally extending interior partition means, this part 64 basically being a horizontal shelf extending from side to side of the unit and including a cutout for each of the discharge openings of the fan 40. Another part 66 also extends from side to side and is inclined from an edge of the shelf 64 to extend downwardly with its opposite edge meeting and joining with the edge of the first part 46 of the generally horizontally extending interior partition means. The lower edge of the wall 66 is formed into a condensate drip tray 68 in the area where it connects with the horizontal shelf 46.

With the foregoing description of the general arrangement of quadrantal spaces in mind, it will be seen in FIG. 1 that the refrigerant coil 38 is located mainly in the first quadrant in an inclined disposition with its upstream face presented to both the first air flow opening 54 in the end wall 34, and the fifth air flow opening 62 in the one portion 46 of the interior wall means. Also, the centrifugal fan means is located in the second quadrant, on the downstream side of the coil and is oriented to discharge air through what may be called sixth air flow openings in the portion 64 of the interior wall means and down into the third quadrantal space.

As stated heretofore, the unit is shown in FIG. 1 in an arrangement for a vertical air flow mode, such as is typical with a roof top installation, with vertically extending return and supply ducts connected to the third and fourth air flow openings 58 and 60, respectively. In this arrangement, air is returned to the unit from the space being served and flows up through third air flow opening 58 into the fourth quadrantal space, then through fifth air flow opening 62 into the first quadrantal space, and through the coil 38 into the second quadrantal space by the centrifugal fans 40, from which it is discharged down through the sixth air flow opening into the third quadrantal space and past any electrical resistance heating modules 44 if installed in the unit, with the conditioned air then exiting from the third quadrantal space through the fourth air flow opening 60 into the duct (not shown) which leads to the served space.

Figure 3:
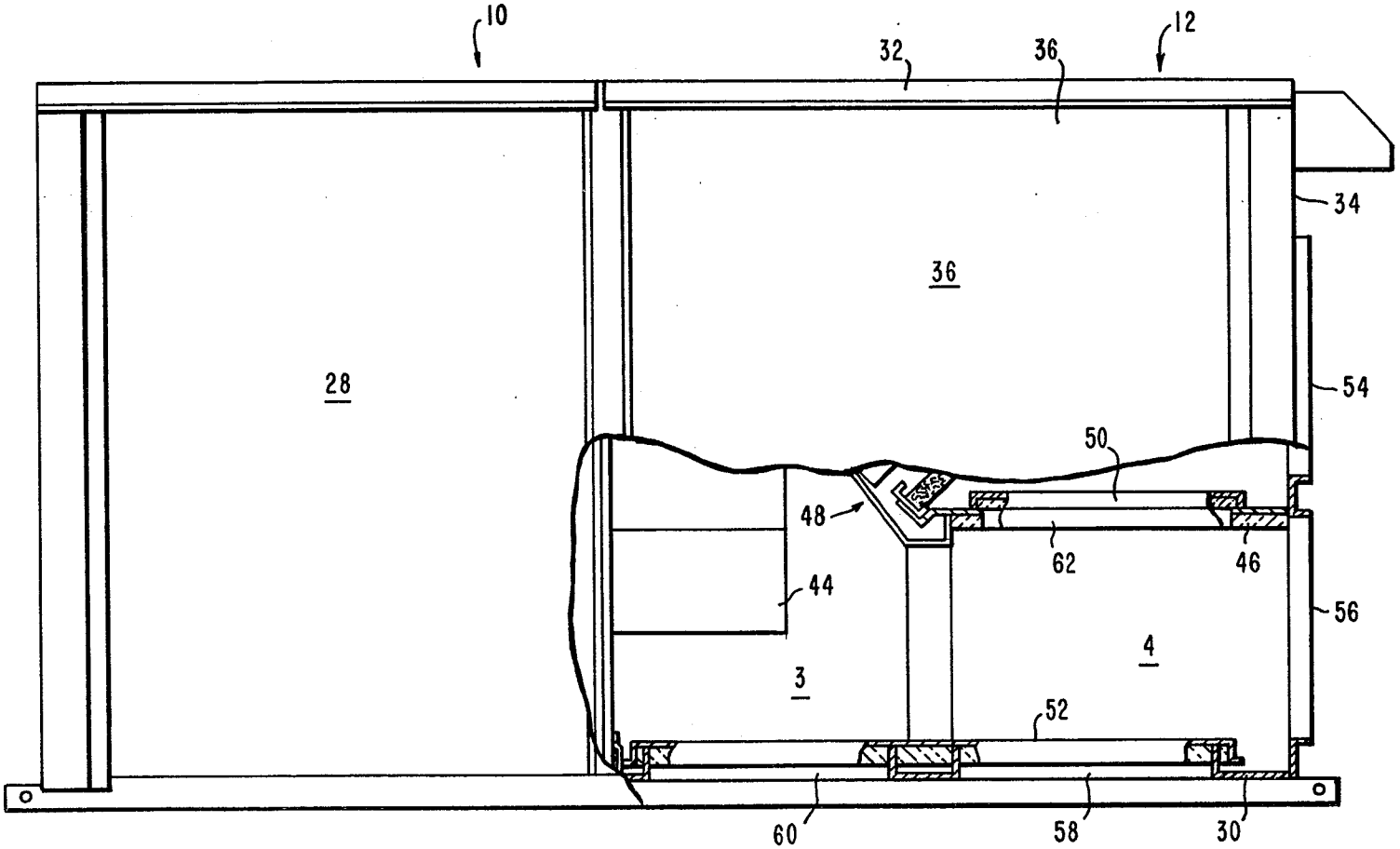
FIG. 3 is a side view as in FIG. 1 with the detachable and removable panels rearranged to accommodate a horizontal air flow mode.

To change the unit from operation in a vertical air flow mode to a horizontal air flow mode, the following changes are made with reference to FIGS. 1 and 3. First, the opposite side panels 36 are removed from the indoor air flow section to permit easy access to the interior. The removable end panel means 52, which as currently preferred comprises a single panel, is removed from its position covering the first and second air flow openings 54 and 56 respectively, by removing perimeter screw fasteners around the panel. Then the detachable panel 50 is removed by loosening two fasteners at each end of the panel disconnecting the condensate pipe (not shown) if it is positioned to extend through the panel, and pulling the panel out of the section. Then the end panel means 52 is tilted diagonally from one side to the other and slid in to the quadrantal spaces 3 and 4 from the end of the unit and placed down in position as shown in FIG. 3 to overlie the third and fourth air flow openings 58 and 60 and fastened along its perimeter. The detachable panel 50 is slipped into position from a side of the unit to overlie the fifth air flow opening 62 is fastened along its longitudinal edges, and any condensate pipe is replaced. Thus the unit is converted from a vertical air flow mode to a horizontal air flow made simply by changing the two panels 50 and 52 to alternate positions. In the horizontal air flow mode, return air from the space being served returns to the unit through the first air flow opening 54 and then passes successively through quadrantal spaces 1, 2, 3, and 4, and exits through the second air flow opening 56 back to the space being served by the unit.

Figure 4:
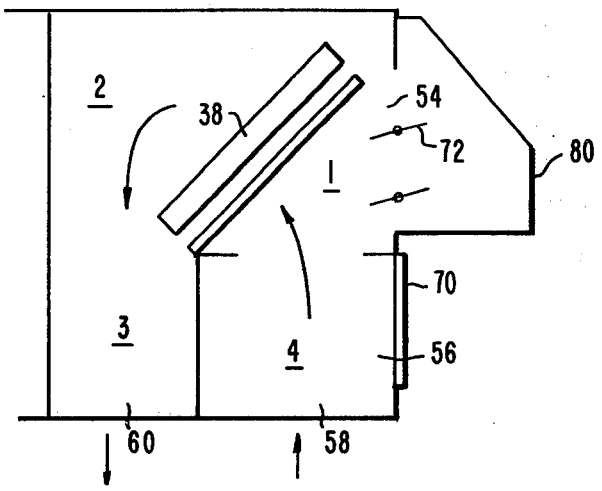
FIGS. 4–6 are schematic illustrations showing positions of various dampers which permit different air flow control options with the unit according to the invention.
Figure 5:
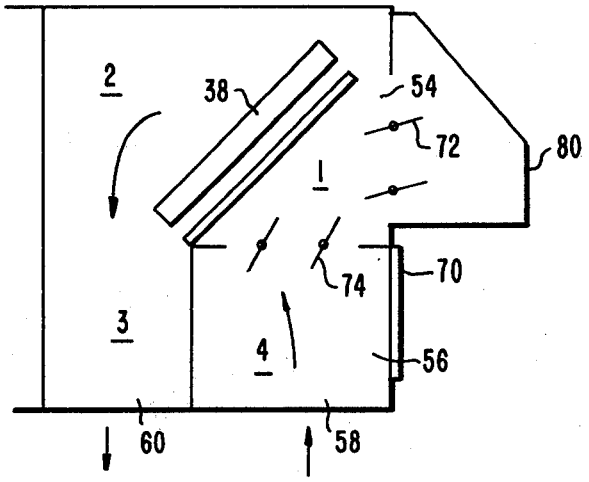
Figure 6:
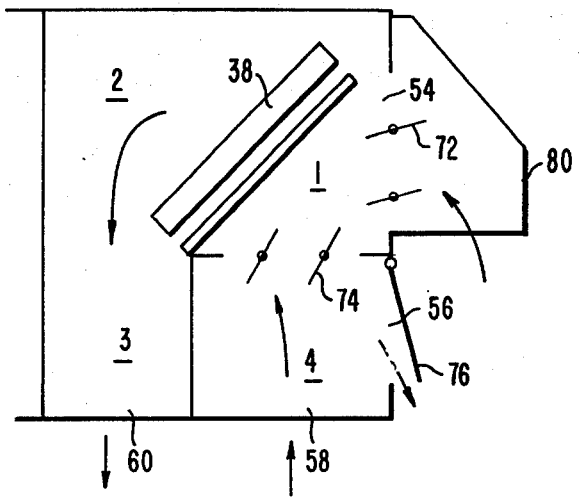

The schematic illustrations of FIGS. 4–6 show air flow control options available when the unit is in its vertical air flow mode arrangement. In FIG. 4 the large removable end panel means 52 is omitted, and a half end panel 70 is used to cover the second air flow opening 56 and an outdoor air damper assembly 72 is installed in the first air flow opening 54. In FIG. 5, a return air damper 74 is located in the fifth air flow opening 62. In FIG. 6, in addition to the outdoor air damper 72 and the return air damper 74, a pressure relief damper 76 is installed in the second air flow opening 56. The outdoor air damper 72 and the return air damper 74 may both be set up for either manual or automatic operation in conventional fashion. The pressure relief damper 76 of course operates to open somewhat in response to a predetermined pressure in the fourth quadrantal space to which it is subject. The damper sections 72-76 are standard commercial items which may be stocked by the distributor, along with the half size panel 70 to be used in those situations in which damper sections are to be used. As rain hood 80 is provided for each of FIGS. 4–6 arrangements.

Referring again to FIG. 1, the end wall 34 also preferably includes a manually operable minimum air damper 78 which is available in either mode of air flow to permit the introduction of a limited amount of outside air.

It will also be appreciated that with the use of the outside air dampers 72 and 74, and automatic enthalpy control system may be utilized in accordance with conventional practice to provide what is called "economizer" operation during periods when cool air is available, so as to reduce the operating time of the refrigeration system.

From the foregoing description, it is believed that the object of generally meeting the disiderata set forth in the earlier part of this application has been reasonably met. The arrangement accommodates the inclusion of electric resistance heating when needed downstream from the refrigerant coil and at the discharge of the centrifugal fans. The arrangement permits the use of a sufficiently large face area refrigerant coil to obtain the capacities desired. The unit can be reasonably easily converted from vertical air flow to horizontal air flow at the distributor's location if necessary and various air flow control options by the use of the several dampers can be obtained, this being possible without the requirement of adding a factory manufactured module to the unit itself. Finally, the unit adapts itself well for operation as a heat pump where this is desirable.

I claim:

1. An air conditioning unit of the type adapted for a roof top or slab installation and for receiving and returning indoor air either horizontally or vertically, comprising:

a cabinet having an intermediate vertical partition separating the interior thereof into an outdoor air flow section containing refrigerant compressor means, a first refrigerant coil, outdoor air blower means, and an indoor air flow section containing a second refrigerant coil and blower means for circulating the air to and from the served space, said cabinet including top, end, side and base walls for said indoor section, said side walls including removable panel means at each of the side walls of said indoor section;

the interior space of said indoor section being viewable from a side as including four generally quadrantal spaces defined as follows, the first quadrantal space being located in an upper corner and bounded exteriorly by the end and top wall, the second quadrantal space being located in an upper corner and bounded exteriorly by the top wall and the intermediate vertical partition, the third quadrantal space being located in a lower corner and bounded exteriorly by the intermediate vertical partition and the bottom wall, and the fourth quadrantal space being located in a lower corner and bounded exteriorly by the bottom wall and the end wall;

said end wall having two vertically separated air flow openings therein, the first opening into said first quadrantal space and the second opening into said fourth quadrantal space, said bottom wall having two additional air flow openings therein horizontally separated from each other, defined as the third opening into the fourth quadrantal space and the fourth opening into the third quadrantal space;

interior wall means having generally horizontally extending portion including one portion separating the first and fourth quadrantal space and another portion separating the second and third quadrantal space, the one portion including a fifth air flow opening generally overlying said third air flow opening in the bottom wall;

said second refrigerant coil being located mainly in said first quadrant in an inclined dispostion with its upstream face presented to both said first air flow opening in said end wall and said fifth air flow opening in said one portion of said interior wall means;

said indoor air blower means being located in said second quadrant on the downstream side of said second refrigerant coil and being oriented to discharge air through sixth air flow opening means in said another portion of said interior wall means and down into said third quadrantal space;

a detachable panel having a first position separating said third and fourth quadrantal spaces and a second, alternate position separating said first and fourth quadrantal spaces and covering said fifth air flow opening;

removable end wall panel means adapted to cover said first and second air flow openings in said end wall in a first position and to cover said third and fourth air flow openings in said base wall in a second, alternate position;

whereby said detachable panel and said end wall panel means in first positions establish a vertical mode air flow path in which return air from the served space passes in sequence through said fourth, first, second, and third quadrantal spaces, and said detachable panel and said end wall panel means in their second, alternate positions establish a horizontal air flow mode in which air passes in sequence through said first, second, third and fourth quadrantal spaces.

2. A unit according to claim 1 including:

electric heater means in said third quadrantal space in the discharge air stream from said indoor air blower means.

3. An air conditioning unit according to claim 1 wherein:

said another portion of said interior wall means includes a horizontally extending portion adjacent said intermediate vertical partition which is elevated relative to the level of said one portion of said horizontal wall means; and a condensate drip tray is located generally intermediate said one portion and said another portion.

4. An air conditioning unit according to claim 1 wherein;

said end wall includes a relatively narrow, horizontally extending minimum air flow opening above and separated from said first air flow opening for the admission of a mimimum quantity of outdoor air; and damper means for controlling said admission of said outdoor air.

5. An air conditioning unit according to claim 1 including:

outdoor air damper means mounted in said first air flow opening of said end wall.

6. An air conditioning unit according to claim 5 including:

return air damper means mounted in said fifth air flow opening and operable in accordance with the positioning of said outdoor air damper.

7. An air conditioning unit according to claim 6 including:

pressure relief damper means mounted in said second air flow opening of said end wall.

8. An air conditioning unit of the type adapted for a roof top or slab installation and for receiving and returning indoor air either horizontally or vertically, comprising:

a cabinet having an intermediate vertical partition separating the interior thereof into an outdoor air flow section containing refrigerant compressor means, a refrigerant coil, outdoor air blower means, and an indoor air flow section containing another refrigerant coil and blower means for circulating air to and from the served space, said cabinet including top end, side and base walls for said indoor section, said side walls including removable panel means at each of the side walls of said indoor section;

said end wall of said indoor section including means defining separate upper and lower air flow openings, and removable end wall panel means covering said last-named openings;

said base wall including means defining separate air flow openings having their major dimensions extending in a sideways direction, one of the openings being closer to said intermediate vertical partition and the other being closer to said end wall;

dividing wall means in said indoor air section separating said indoor section into an upper space and a lower space, said dividing wall means having its boundary adjacent said indoor section end wall at the level of separation between said upper and lower air flow openings of said end wall, said dividing wall means including an air flow opening generally overlying said one air flow opening in said base wall;

said indoor air refrigerant coil being disposed in said indoor air section in said upper space and in an inclined disposition with its upstream face presented to both said end wall upper air flow opening and said dividing wall means air flow opening;

said indoor air blower means located in said upper space of said indoor air seciton and on the downstream side of said refrigerant coil and being oriented to discharge air through opening means in said dividing wall means adjacent said intermediate vertical partition and down into said lower space;

a detachable vertical panel in said lower space and extending sideways between the opposite sides of said indoor air flow section and extending vertically between said base wall and said dividing wall means, with the two air flow openings in the base wall thereby being located on opposite sides of said detachable vertical panel;

said detachable vertical panel having an extent adequate to cover said air flow opening in said dividing wall means when placed in such an alternate position, and said removable end wall panel means having an extent adequate to cover said two air flow openings in said base wall when placed in such an alternate position;

said detachable vertical panel and said removable end wall panel means being placed in positions to cover the openings to which they are related to change the indoor section from the vertical air flow mode to a horizontal air flow mode.

9. An arrangement of the indoor air flow section of the roof top type air conditioning unit, comprising:

a cabinet including top, bottom, end and side walls and containing a stationary, inclined refrigerant coil, and stationary fan means in draw through relation to said coil, both said coil and fan being in the upper portion of the space in said cabinet;

said end wall having a first upper and a second lower air flow opening;

said base wall having a third and a fourth air flow opening;

detachable partition means having a first generally vertical position extending from said base wall to a lower edge of said coil to separate the interior spaces adjacent said third and fourth openings, and a second generally horizontal, alternate position covering an open area between the lower edge of said coil and said end wall;

end wall panel means having a first vertical position covering said first and second air flow openings, and a second alternate horizontal position covering said third and fourth openings;

whereby said partition means and panel means in said first positions establish a vertical air flow mode by which air enters and leaves said cabinet through the bottom wall, and in said alternate positions establish a horizontal air flow mode in which air enters and leaves said cabinet through said end wall openings.

* * * * *